US011355301B2

(12) United States Patent
Wei et al.

(10) Patent No.: US 11,355,301 B2
(45) Date of Patent: Jun. 7, 2022

(54) ON-CHIP MICRO ELECTRON SOURCE AND MANUFACTURING METHOD THEREOF

(71) Applicant: PEKING UNIVERSITY, Beijing (CN)

(72) Inventors: Xianlong Wei, Beijing (CN); Wei Yang, Beijing (CN)

(73) Assignee: PEKING UNIVERSITY, Beijing (CN)

( * ) Notice: Subject to any disclaimer, the term of this patent is extended or adjusted under 35 U.S.C. 154(b) by 0 days.

(21) Appl. No.: 17/292,862

(22) PCT Filed: Nov. 7, 2019

(86) PCT No.: PCT/CN2019/116135
§ 371 (c)(1),
(2) Date: May 11, 2021

(87) PCT Pub. No.: WO2020/098555
PCT Pub. Date: May 22, 2020

(65) Prior Publication Data

US 2021/0398766 A1 Dec. 23, 2021

(30) Foreign Application Priority Data

Nov. 12, 2018 (CN) ..... 201811340399.2
Nov. 12, 2018 (CN) ..... 201821854867.3

(51) Int. Cl.
*H01J 9/18* (2006.01)
*H01J 3/02* (2006.01)

(52) U.S. Cl.
CPC ..... *H01J 3/026* (2013.01); *H01J 9/18* (2013.01)

(58) Field of Classification Search
CPC ..... H01J 3/026; H01J 9/18
(Continued)

(56) References Cited

U.S. PATENT DOCUMENTS

2007/0018561 A1 1/2007 Nukanobu et al.
2009/0237570 A1 9/2009 Moriguchi et al.
(Continued)

FOREIGN PATENT DOCUMENTS

CN 1913076 A 2/2007
CN 107248489 A 10/2017
(Continued)

OTHER PUBLICATIONS

PCT International Search Report and Written Opinion, International Application No. PCT/CN2019/116135, dated Jan. 23, 2020, 13 Pages.
(Continued)

*Primary Examiner* — Christopher M Raabe
(74) *Attorney, Agent, or Firm* — Fenwick & West LLP

(57) ABSTRACT

Provided are an on-chip miniature electron source and a method for manufacturing the same. The on-chip miniature electron source includes: a thermal conductive layer; an insulating layer provided on the thermal conductive layer, where the insulating layer is made of a resistive-switching material, and at least one through hole is provided in the insulating layer; and at least one electrode pair provided on the insulating layer, where at least one electrode of the electrode pair is in contact with and connected to the thermal conductive layer via the through hole, where there is a gap between two electrodes of the electrode pair, and a tunnel junction is formed within a region of the insulating layer under the gap. Thus, heat generated by the on-chip micro electron source can be dissipated through the electrode and the thermal conductive layer, thereby significantly improving heat dissipation ability of the on-chip miniature electron source.

15 Claims, 11 Drawing Sheets

(58) Field of Classification Search
USPC ..... 313/40
See application file for complete search history.

(56) References Cited

U.S. PATENT DOCUMENTS

| | | | | |
|---|---|---|---|---|
| 2019/0198279 | A1 | 6/2019 | Wei et al. | |
| 2021/0050369 | A1* | 2/2021 | Or-Bach | H01L 23/5283 |
| 2021/0398769 | A1* | 12/2021 | Wei | H01J 35/12 |

FOREIGN PATENT DOCUMENTS

| | | | | |
|---|---|---|---|---|
| CN | 109285740 | A | | 1/2019 |
| CN | 209056458 | U | | 7/2019 |
| CN | 111627786 | A | * | 9/2020 |
| JP | H03261026 | A | | 11/1991 |
| JP | H04132139 | A | | 5/1992 |
| JP | H1064406 | A | | 3/1998 |
| JP | 2000323075 | A | | 11/2000 |

OTHER PUBLICATIONS

The Japan Patent Office, Office Action, Japanese Patent Application No. 2021-525686, dated Apr. 12, 2022, six pages.

* cited by examiner

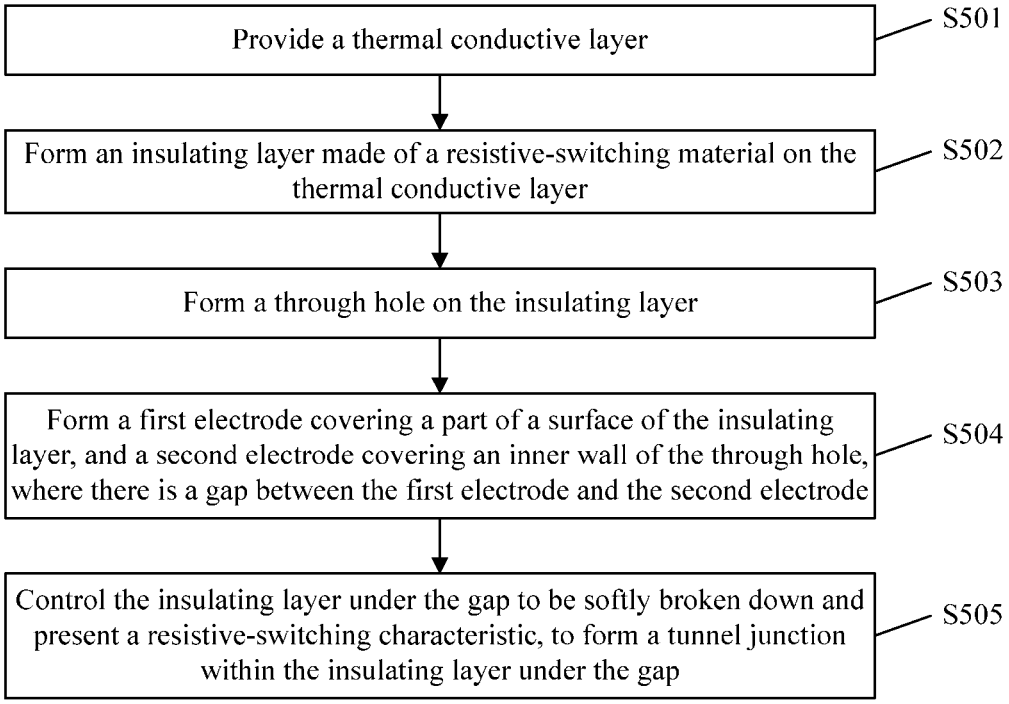
Figure 5
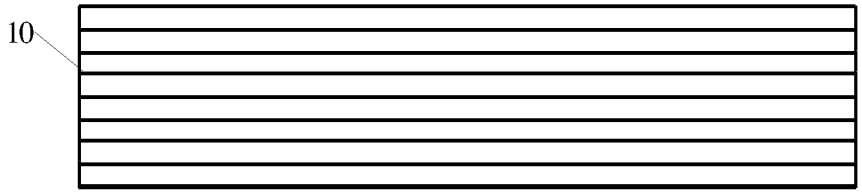
Figure 6 (1)
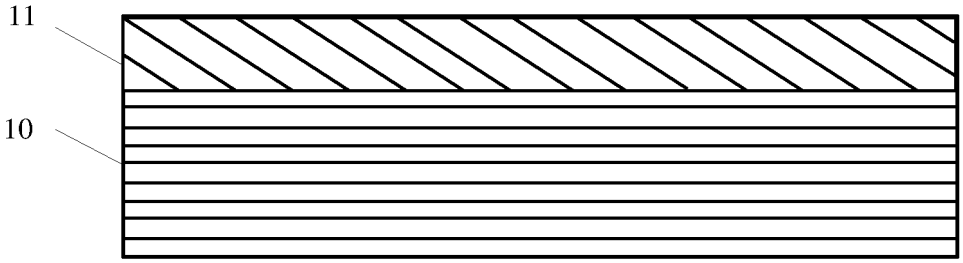
Figure 6 (2)

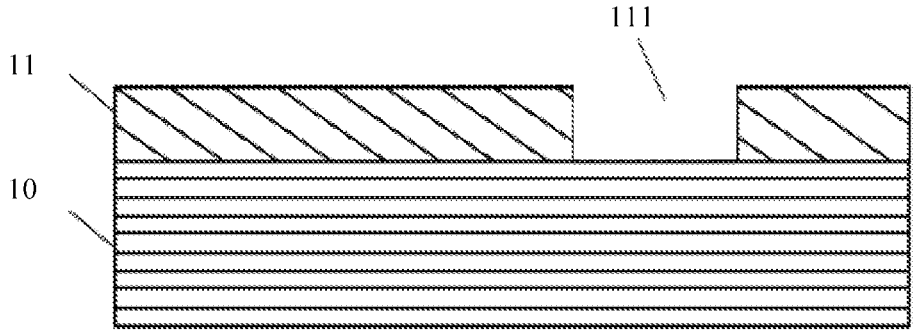
Figure 6 (3)
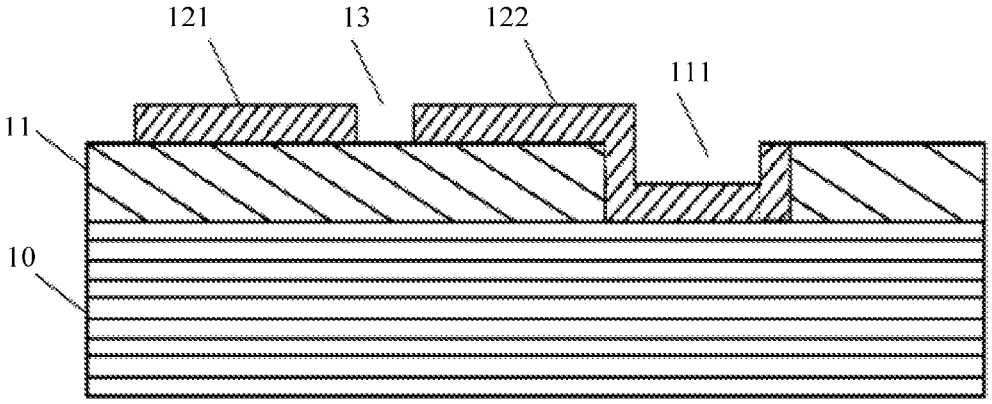
Figure 6 (4)

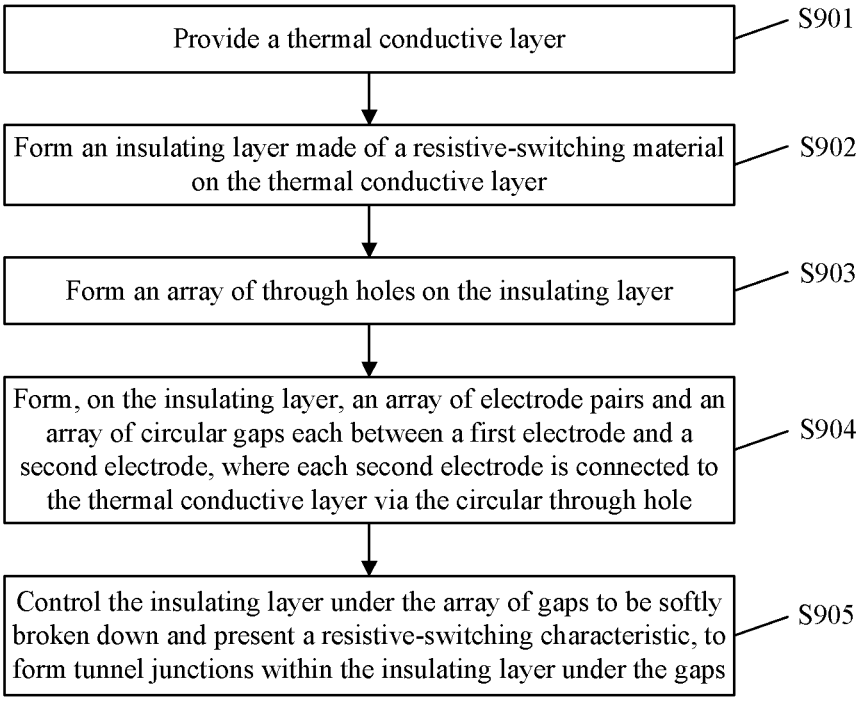
Figure 9
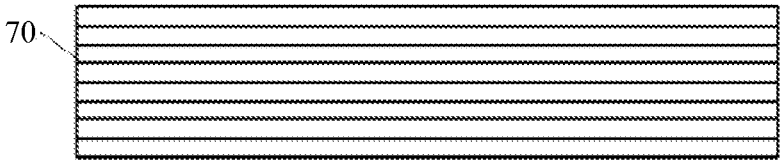
Figure 10 (1)

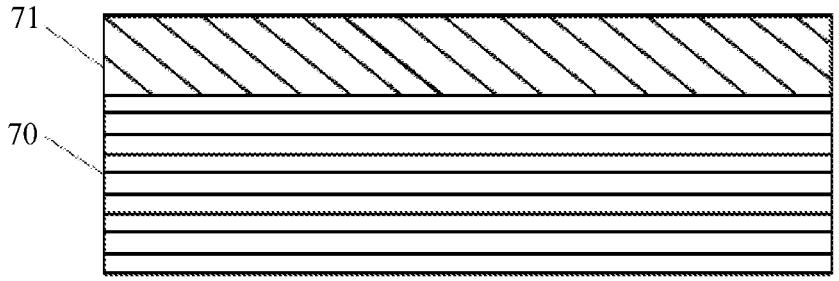
Figure 10 (2)
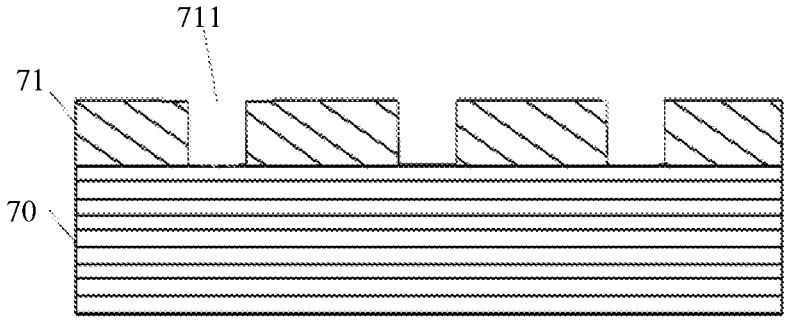
Figure 10 (3)
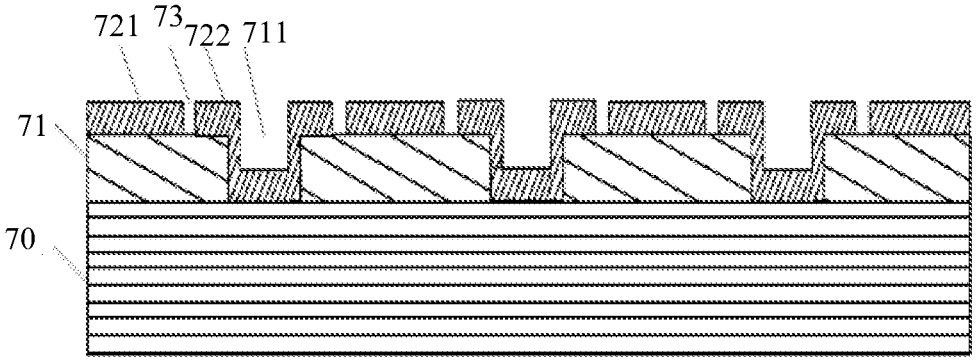
Figure 10 (4)

ON-CHIP MICRO ELECTRON SOURCE AND MANUFACTURING METHOD THEREOF

This application is a 35 U.S.C 371 Patent Application of PCT Application No. PCT/CN2019/116135, filed on Nov. 7, 2019, and titled "ON-CHIP MICRO ELECTRON SOURCE AND MANUFACTURING METHOD THEREOF" which claims the priorities to Chinese Patent Application No. 201811340399.2, titled "ON-CHIP MINIATURE ELECTRON SOURCE AND MANUFACTURING METHOD THEREOF", filed on Nov. 12, 2018 with the China National Intellectual Property Administration (CNIPA), and Chinese Patent Application No. 201821854867.3, titled "ON-CHIP MINIATURE ELECTRON SOURCE", filed on Nov. 12, 2018 with the China National Intellectual Property Administration (CNIPA), each of which are incorporated herein by reference in their entireties

FIELD

The present disclosure relates to the field of electronic science and technology, and in particular to an on-chip miniature electron source and a method for manufacturing the same.

BACKGROUND

Vacuum electronic devices such as X-ray tubes, microwave tubes, cathode ray tubes and the like are widely used in aerospace, medical health, scientific research and other important fields. However, the vacuum electronic devices still have problems such as large size, high power consumption and difficult integration, and a solution for solving these problems is to realize a miniaturized on-chip vacuum electronic device. An electron source is an indispensable key component for all the vacuum electronic devices, and provides the vacuum electronic devices with a free electron beam necessary for its work. At present, the miniaturization and on chip of the electron source is one of the main factors that limit the miniaturization and on chip of the vacuum electronic device. Therefore, an on-chip miniature electron source with high performance is an electronic component that is urgently needed in the field of vacuum electronics.

Researches on the on-chip miniature electron source began in the 1960s, and currently there are a variety of on-chip miniature electron sources. However, the existing on-chip miniature electron source has a small overall emission current, which is difficult to meet more application requirements.

SUMMARY

In view of the above, an on-chip miniature electron source and a method for manufacturing the same are provided in the present disclosure, so as to improve an overall emission current of the on-chip miniature electron source, and thus meet more application requirements.

To solve the above technical problems, technical solutions proposed in the present disclosure are as follows.

An on-chip miniature electron source includes: a thermal conductive layer; an insulating layer provided on the thermal conductive layer, where the insulating layer is made of a resistive-switching material, and at least one through hole is provided in the insulating layer; and at least one electrode pair provided on the insulating layer, where at least one electrode of the electrode pair is in contact with and connected to the thermal conductive layer via the through hole, in which, there is a gap between two electrodes of the electrode pair, and a tunnel junction is formed within a region of the insulating layer under the gap.

In an embodiment, the gap has a width less than or equal to 10 microns.

In an embodiment, the on-chip miniature electron source further includes: an extraction electrode, where the extraction electrode includes an extraction electrode layer and an insulating support structure provided on a side of the extraction electrode layer, at least one hole is provided in the extraction electrode layer, and the insulating support structure is located between the electrode pair and the extraction electrode layer, so that the extraction electrode layer is suspended over the electrode pair.

In an embodiment, the on-chip miniature electron source further includes: a heat sink provided under the thermal conductive layer, where the thermal conductive layer is attached to the heat sink.

In an embodiment, the insulating layer is made of one or more materials selected from: silicon oxide, tantalum oxide, hafnium oxide, tungsten oxide, zinc oxide, magnesium oxide, zirconium oxide, titanium oxide, aluminum oxide, nickel oxide, germanium oxide, diamond and amorphous carbon.

In an embodiment, the electrodes of the electrode pair are made of one or more materials selected from metal, graphene, and carbon nanotube.

In an embodiment, the thermal conductive layer is made of one or more materials selected from metal, diamond, and heavily doped semiconductor.

In an embodiment, the thermal conductive layer is a substrate, or a material layer provided on the substrate.

A method for manufacturing an on-chip miniature electron source includes: providing a thermal conductive layer; forming, on the thermal conductive layer, an insulating layer made of a resistive-switching material, where at least one through hole is provided on the insulating layer; forming at least one electrode pair covering a part of a surface of the insulating layer, where there is a gap between two electrodes of the electrode pair, and at least one electrode of the electrode pair is in contact with and connected to the thermal conductive layer via the through hole; and controlling the insulating layer under the gap to be softly broken down and present a resistive-switching characteristic, to form a tunnel junction within a region of the insulating layer under the gap.

In an embodiment, the method further includes: preparing an extraction electrode, where the extraction electrode includes an extraction electrode layer and an insulating support structure provided on a side of the extraction electrode layer, and at least one hole is provided in the extraction electrode layer; and before or after the controlling the insulating layer under the gap to be softly broken down and present a resistive-switching characteristic, to form a tunnel junction within a region of the insulating layer under the gap, the method further includes: attaching the insulating support structure to the electrode pair, and/or attaching the insulating support structure to the insulating layer, so that the extraction electrode layer is suspended over the electrode pair.

In an embodiment, the method further includes: forming a heat sink under the thermal conductive layer, where the heat sink is in contact with the thermal conductive layer.

Compared with the conventional technology, the present disclosure has the following beneficial effects.

Based on the above technical solutions, the on-chip miniature electron source according to the present disclosure is provided with a thermal conductive layer, and at least one electrode of a same electrode pair is connected to the thermal conductive layer via a through hole in the insulating layer. In this way, heat generated by the on-chip miniature electron source may be dissipated through the electrode and the thermal conductive layer, thereby significantly improving heat dissipation capacity of the on-chip electron source. Therefore, the on-chip miniature electron source may have multiple electron sources integrated on a same substrate, forming an array of electron sources with high integration. Therefore, the on-chip electron source has a larger overall emission current, and thus meets more application requirements. For example, the on-chip miniature electron source provided in the present disclosure may be widely used in various electronic devices involving an electron source, such as an X-ray tube, a microwave tube, a flat panel display, and the like.

BRIEF DESCRIPTION OF THE DRAWINGS

FIG. 5 is a schematic flowchart of a method for manufacturing an on-chip miniature electron source according to an embodiment of the present disclosure;

FIG. 6(1) to FIG. 6(4) are schematic sectional views of structures corresponding to a series of processes in the method for manufacturing the on-chip miniature electron source according to the first embodiment of the present disclosure;

FIG. 9 is a schematic flowchart of a method for manufacturing the on-chip miniature electron source according to the second embodiment of the present disclosure;

FIG. 10(1) to FIG. 10(4) are schematic sectional views of structures corresponding to a series of processes in the method for manufacturing the on-chip miniature electron source according to the second embodiment of the present disclosure;

DETAILED DESCRIPTION

Figure 1:
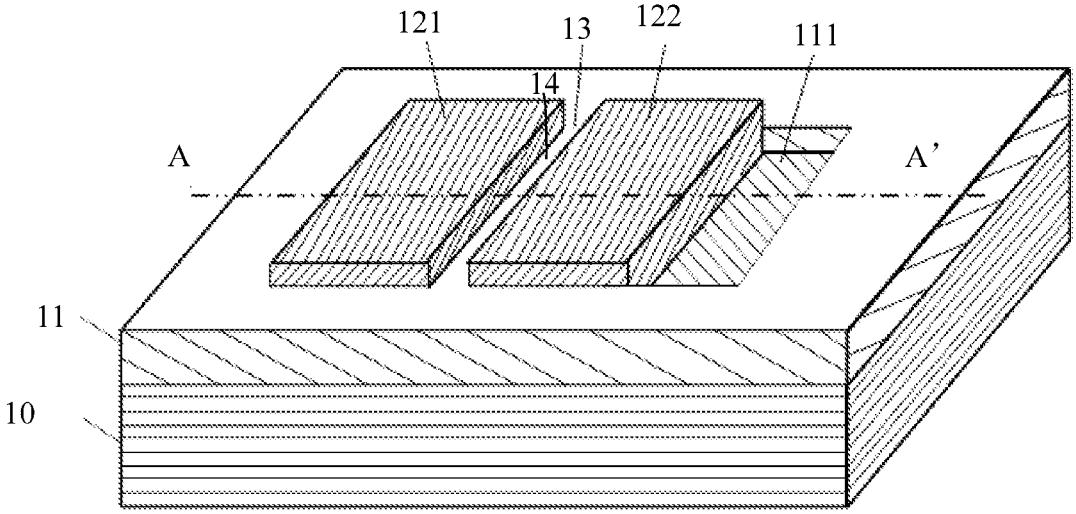
FIG. 1 is a schematic three-dimensional view of a structure of an on-chip miniature electron source according to a first embodiment of the present disclosure.

Researches on the on-chip miniature electron source began in the 1960s, and currently there are a variety of on-chip electron sources, such as a field emission on-chip electron source based on a micro-tip structure, a tunneling electron source based on a metal-insulating layer-metal (MIM) tunnel junction, a negative electron affinity on-chip electron source, an on-chip miniature thermal emission electron source, and the like.

The main problems of the field emission on-chip electron source are high working voltage, ultra-high vacuum required for stable work, poor array homogeneity, and the like. The main problems of the MIM tunneling electron source and the negative electron affinity electron source are low electron emission efficiency, low emission current density, and the like. Besides low emission efficiency and low emission current density, the main problems of the on-chip miniature thermal emission electron source further include high local temperature, high power consumption, and the like.

In order to solve the above-mentioned problems of the on-chip electron source, a surface tunneling electron source based on a resistive-switching material is provided in the present disclosure, as an embodiment of the present disclosure. The surface tunneling electron source is a surface tunneling miniature electron source with a planar multi-region structure. Specifically, the surface tunneling electron source includes a substrate, and there are two electrical conductive regions and an insulating region formed on a surface of the substrate. Specifically, the insulating region is located between the two electrical conductive regions, and is connected to the two electrical conductive regions, thereby forming a tunnel junction. The surface tunneling electron source further includes an electrode pair. A voltage is applied to the surface tunneling electron source through the electrode pair, so that electrons are enabled to tunnel in the tunnel junction from an electrical conductive region having a low potential to enter the electrical conductive region having a high potential through the insulating region, and then are emitted into vacuum from a boundary of the electrical conductive region having a high potential near the insulating region.

Compared with a conventional vertical tunneling electron source with a multi-layer MIM structure, electrons of the surface tunneling electron source do not need to pass through multiple material layers during emission, which achieves higher emission efficiency.

For the surface tunneling electron source, in order to meet the actual application requirements (generally in milliamps) for an emission current, it is necessary to form an array of surface tunneling electron sources integrated on a surface of a same substrate, thereby increasing the overall emission current. However, when the surface tunneling electron source is working, heat will be generated by components on the surface of the substrate, while the substrate has a poor thermal conductivity, and thus if there are too many integrated arrays, the heat will quickly accumulate on the surface of the substrate, resulting in a sharp rise of the temperature of the device and failure of the device eventually. Thus, to ensure a normal function of the device, it is necessary to limit the number of integrated arrays not to exceed 100, which greatly limits the magnitude of overall emission current.

In order to improve the heat dissipation performance of the surface tunneling electron source and thereby increase the overall emission current, an on-chip miniature electron source is provided in the present disclosure, as another embodiment of the present disclosure. The on-chip miniature electron source includes: a thermal conductive layer; an insulating layer provided on the thermal conductive layer, where the insulating layer is made of a resistive-switching material, and at least one through hole is provided in the insulating layer; and at least one electrode pair provided on the insulating layer, where at least one electrode of the electrode pair is in contact with and connected to the thermal conductive layer via the through hole, and there is a gap between two electrodes of the electrode pair. In this way, in the on-chip miniature electron source, the electrode is connected to the thermal conductive layer via a through hole in the insulating layer. Thus, heat generated by the on-chip miniature electron source may be dissipated through the electrode and the thermal conductive layer, thereby significantly improving the heat dissipation capacity of the on-chip electron source. Therefore, the on-chip miniature electron source may integrate multiple single electron sources on a same substrate, forming an array of electron sources with high integration, so that the on-chip electron source has a larger overall emission current and thus meets more application requirements. For example, the on-chip miniature electron source provided in the present disclosure may be widely used in various electronic devices involving an electron source, such as an X-ray tube, a microwave tube, a flat panel display, and the like.

In order to make the above objects, features and advantages of the present disclosure more apparent and easier to be understood, specific implementations of the present disclosure are illustrated in detail in conjunction with accompanying drawings.

It should be noted that, there may be one or more tunnel junctions provided on the on-chip miniature electron source in embodiments of the present disclosure. An implementation of an on-chip miniature electron source with only one tunnel junction is firstly described as follows.

First Embodiment

Figure 2:
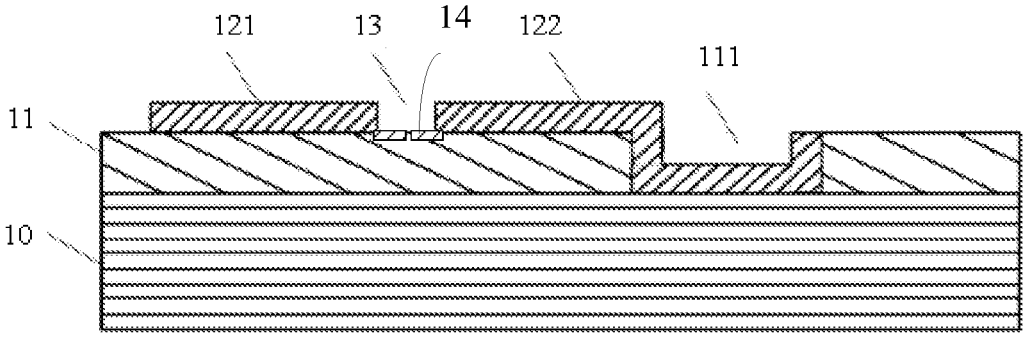
FIG. 2 is a schematic sectional view of a structure of the on-chip miniature electron source according to the first embodiment of the present disclosure, which is taken along the dashed line A-A' in FIG. 1.

Reference is made to FIG. 1 and FIG. 2, in which FIG. 1 is a schematic three-dimensional view of a structure of an on-chip miniature electron source according to a first embodiment of the present disclosure, and FIG. 2 is a schematic sectional view of a structure of the on-chip miniature electron source taken along the dashed line A-A' in FIG. 1.

The on-chip miniature electron source includes: a thermal conductive layer 10; an insulating layer 11 provided on the thermal conductive layer 10, where the insulating layer 11 is made of a resistive-switching material, and a through hole 111 is provided in the insulating layer 11; and an electrode pair provided on the insulating layer 11, where the electrode pair includes a first electrode 121 and a second electrode 122, and the second electrode 122 is in contact with and connected to the thermal conductive layer 10 via the through hole 111, there is a gap 13 between the first electrode 121 and the second electrode 122, and a tunnel junction 14 is formed within the insulating layer 11 under the gap 13.

Figure 3:
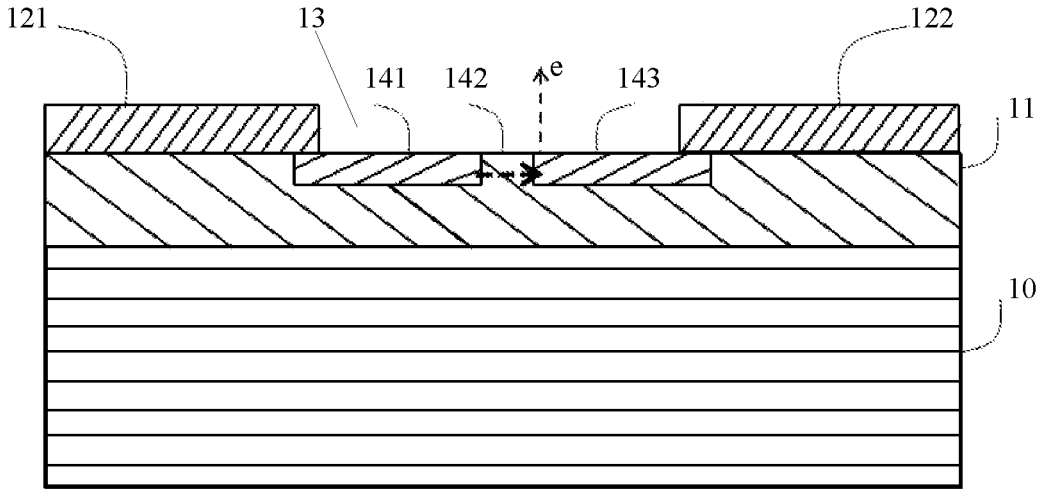
FIG. 3 is a schematic diagram of a structural principle of the on-chip miniature electron source according to the first embodiment of the present disclosure.

In order to clearly understand the technical solutions disclosed in the present disclosure, FIG. 3 shows a structural principle diagram of the on-chip miniature electron source according to the embodiment of the present disclosure. As shown in FIG. 3, the insulating layer 11 under the gap 13 between the first electrode 121 and the second electrode 122 is softly broken down. In this way, a conductive filament that traverses the entire insulating layer 11 under the gap 13 is formed within the region of the insulating layer, so that the region of the insulating layer transforms from an insulating state to a conductive state, and then undergoes a transition from a low-resistance state to a high-resistance state. After that, the conductive filament is broken, and a tunnel junction 14 as shown in FIG. 3 is formed within the region of the insulating layer under the gap 13. The tunnel junction 14 is from the first electrode 121 to the second electrode 122, including a first electrical conductive region 141, an insulating region 142, and a second electrical conductive region 143 that are connected in sequence.

Figure 4:
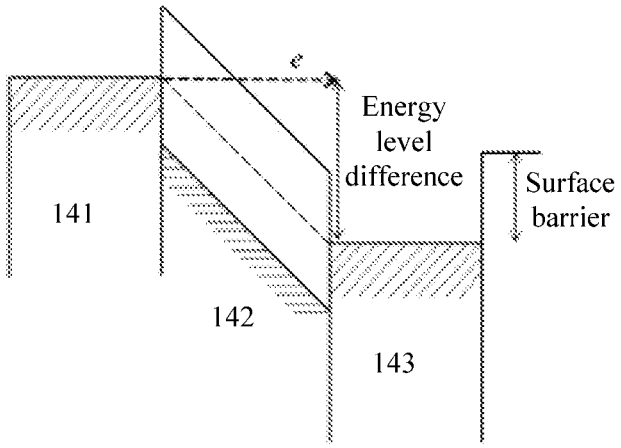
FIG. 4 is a schematic diagram of a band structure of a tunnel junction in an on-chip miniature electron source according to an embodiment of the present disclosure.

A band diagram of the tunnel junction formed within the region of the insulating layer 11 under the gap 13 is shown in FIG. 4. When a voltage is applied across the first electrode 121 and the second electrode 122, an electron tunnels from the first electrical conductive region 141 with a low potential to the insulating region 142, and is accelerated in the insulating region 142 to obtain energy over the vacuum energy level. The electron is emitted when reaching the second electrical conductive region 143 with a high potential.

It should be noted that, the term "on" used in embodiments of the present disclosure represents that two adjacent layers are in contact with each other.

In addition, the thermal conductive layer 10 may be a substrate with good thermal conductivity, or a thermal conductive material layer provided on a substrate. When the thermal conductive layer 10 is a thermal conductive material layer provided on a substrate, the thermal conductivity of the substrate is not limited. In other words, the substrate may or may not have good thermal conductivity.

In the embodiment of the present disclosure, description is made using an example in which the thermal conductive layer 10 is a substrate with good thermal conductivity.

As an embodiment, the thermal conductive layer 10 may be made of one or more materials selected from metal, diamond, and heavily doped semiconductor.

As an example, the thermal conductive layer 10 may be made of a material with good electrical conductivity, in order to facilitate a provision of an electrical signal to the on-chip miniature electron source during operation in the embodiment of the present disclosure. As an example, the material with good electrical conductivity may be, for example, metal or heavily doped semiconductor.

In the embodiment of the present disclosure, the insulating layer 11 is made of a resistive-switching material. The resistive-switching material refers to a material that is initially electrically insulating, presents a resistive-switching state and has an ability to emit electrons after soft breakdown by a voltage applied thereon, and transforms from an electrically insulating material into a conductive material after being activated.

As an example, the insulating layer 11 may be made of one or more materials selected from: silicon oxide, tantalum oxide, hafnium oxide, tungsten oxide, zinc oxide, magnesium oxide, zirconium oxide, titanium oxide, aluminum oxide, nickel oxide, germanium oxide, diamond and amorphous carbon. When being softly broken down, the above-mentioned materials all may realize the transition from a low-resistance state to a high-resistance state and have the ability to emit electrons.

As an example of the present disclosure, the through hole 111 provided in the insulating layer 11 may be set with different shapes, such as rectangular or circular, based on process conditions or actual requirements. It is shown in FIG. 1 that the through hole 111 is in a shape of rectangular.

It should be noted that the second electrode 122 may cover the insulating layer around the through hole 111.

In addition, the first electrode 121 or the second electrode 122 may be made of any material for making an electrode. As an example, the first electrode 121 or the second electrode 122 may be made of one or more materials selected from metal, graphene, and carbon nanotube.

A voltage is applied across the first electrode 121 and the second electrode 122, to realize the operation of the on-chip micro electron source.

As an example, the gap 13 between the first electrode 121 and the second electrode 122 may have a width less than or equal to 10 μm. The gap 13 with a smaller width is beneficial to controlling a formation of an insulating region with a smaller width in the tunnel junction 14, thereby ensuring that significant electron tunneling and electron emission may occur and the insulating region will not be broken down when a voltage greater than the surface barrier of the electrical conductive region is applied.

The above illustrates an implementation of the on-chip miniature electron source according to the first embodiment of the present disclosure. In the implementation, the thermal conductive layer 10 is provided, and the second electrode 122 is connected to the thermal conductive layer 10 via the through hole 111 of the insulating layer 11. In this way, heat generated by the on-chip miniature electron source may be dissipated through the second electrode 122 and the thermal conductive layer 10, thereby significantly improving the heat dissipation capacity of the on-chip electron source. Therefore, the on-chip miniature electron source may integrate multiple single electron sources on a same substrate, forming an array of electron sources with high integration, so that the on-chip electron source has a larger overall emission current and therefore meets more application requirements. For example, the on-chip miniature electron source provided in the present disclosure may be widely used in various electronic devices involving an electron source, such as an X-ray tube, a microwave tube, a flat panel display, and the like.

Moreover, in the above first embodiment, the heat dissipation of the on-chip miniature electron source is accelerated by the connection between the second electrode 122 of each electrode pair and the thermal conductive layer 10 via the through hole 111. In fact, when the thermal conductive layer 10 is made of an insulating material, the first electrode 121 and the second electrode 122 may be in contact with and connected to the thermal conductive layer 10 via different through holes 111 respectively, so as to achieve a further improvement of the heat dissipation capability of the on-chip miniature electron source.

Based on the implementation of the on-chip miniature electron source provided in the above first embodiment, an implementation of a method for manufacturing the on-chip miniature electron source is further provided in the present disclosure.

Reference is made to FIG. 5 to FIG. 6(4), in which FIG. 5 is a schematic flowchart of the method for manufacturing the on-chip miniature electron source according to the first embodiment of the present disclosure; and FIG. 6(1) to FIG. 6(4) are schematic sectional views of structures corresponding to a series of processes in the method for manufacturing the on-chip miniature electron source according to the first embodiment of the present disclosure.

The method for manufacturing the on-chip miniature electron source according to the first embodiment includes steps S501 to S505.

In step S501, a thermal conductive layer 10 is provided.

The thermal conductive layer 10 may be made of a material that is the same as the material of the thermal conductive layer 10 of the on-chip miniature electron source in FIG. 1, which is not repeated hereinafter for the sake of brevity.

A schematic sectional view of a structure obtained by step S501 is shown in FIG. 6(1).

In step S502, an insulating layer 11 made of a resistive-switching material is formed on the thermal conductive layer 10.

Step S502 may specifically include: forming an insulating layer on the thermal conductive layer 10 by using a thin film deposition process or a thermal oxidation process which are commonly used in the art.

A schematic sectional view of a structure obtained by step S502 is shown in FIG. 6(2).

In step S503, a through hole 111 is formed on the insulating layer 11.

The through hole 111 may be formed using a process of dry etching or wet etching. As an example, the dry etching may be reactive gas etching, plasma etching, or the like.

When forming the through hole 111 in the insulating layer 11 through wet etching, step S503 may specifically include: spin-coating electron beam photoresist on the insulating layer 11, and forming a rectangular through hole 111 on the insulating layer 11 by processes of electron beam exposure, developing and fixing, wet etching and lift-off process.

A schematic sectional view of a structure obtained by step S503 is shown in FIG. 6(3).

In step S504, an electrode pair covering a part of a surface of the insulating layer 11 is formed. The electrode pair includes a first electrode 121 and a second electrode 122. The second electrode 122 is in contact with and connected to the thermal conductive layer 10 via the through hole 111, and there is a gap 13 between the first electrode 121 and the second electrode 122.

As an example, step S504 may specifically include: depositing an electrode material layer on the insulating layer 11 and an inner wall of the through hole 111 by using an electrode deposition process that is commonly used in the art, including processes of spin coating of electron beam photoresist, electron beam exposure, developing and fixing, metal thin film deposition and lift-off process, to form the first electrode 121 covering a part of the surface of the insulating layer 11, the second electrode 122 covering the inner wall of the through hole 111, and the gap 13 between the first electrode 121 and the second electrode 122.

When covering the inner wall of the through hole 111, the second electrode 122 may be in contact with and connected to the thermal conductive layer 10 via the through hole 111, thereby significantly improving the heat dissipation capability of the on-chip miniature electron source.

It should be noted that, in the embodiment of the present disclosure, the second electrode 122 does not need to cover the entire inner wall of the through hole 111, but only a part of the inner wall thereof.

A schematic sectional view of a structure obtained by step S504 is shown in FIG. 6(4).

In step S505, the insulating layer 11 under the gap 13 is controlled to be softly broken down and present a resistive-switching characteristic, to form a tunnel junction 14 within the insulating layer under the gap 13.

Specifically, step S505 may be performed as follows. A voltage is applied across the first electrode 121 and the second electrode 122, and the value of the voltage is gradually increased. Meanwhile, the magnitude of a current is monitored, and a limit current is set to a certain current value, such as 100 μA. When the current increases suddenly and sharply, the increasing of the voltage is terminated. At this time, the insulating layer 11 under the gap 13 is softly broken down and presents the resistive-switching characteristic. In this way, a conductive filament that traverses the insulating layer 11 under the entire gap 13 is formed in the region of the insulating layer, so that the region of the insulating layer transforms from an insulating state to a conductive state, and then undergoes a transition from a low-resistance state to a high-resistance state. After that, the conductive filament is broken, and a tunnel junction 14 as shown in FIG. 3 is formed within the region of the insulating layer under the gap 13. The tunnel junction 14 is from the first electrode 121 to the second electrode 122, including a first conductive region 141, an insulating region 142, and a second conductive region 143 that are connected in sequence.

It should be noted that in a case that the thermal conductive layer 10 has good electrical conductivity, since the second electrode 122 is in contact with and connected to the thermal conductive layer 10, the second electrode 122 is electrically connected to the thermal conductive layer 10. In this case, step S505 may be performed by applying a voltage across the first electrode 121 and the thermal conductive layer 10, so that the insulating layer 11 under the gap 13 is softly broken down and presents a resistive-switching characteristic, to form a tunnel junction 14 in the insulating layer under the gap 13.

A schematic view of a structure obtained by step S505 is shown in FIG. 1 and FIG. 2.

The above illustrates an implementation of the method for manufacturing the on-chip miniature electron source according to the first embodiment of the present disclosure.

The above embodiment illustrates an on-chip miniature electron source including only one tunnel junction 14 and a method for manufacturing the same. In order to increase the overall emission current of the on-chip miniature electron source, an array of multiple tunnel junctions may be further provided on the on-chip miniature electron source. Based on this, an embodiment with improved overall emission current of the on-chip miniature electron source is provided in the present disclosure, and reference may be made to a second embodiment.

Second Embodiment

Figure 7:
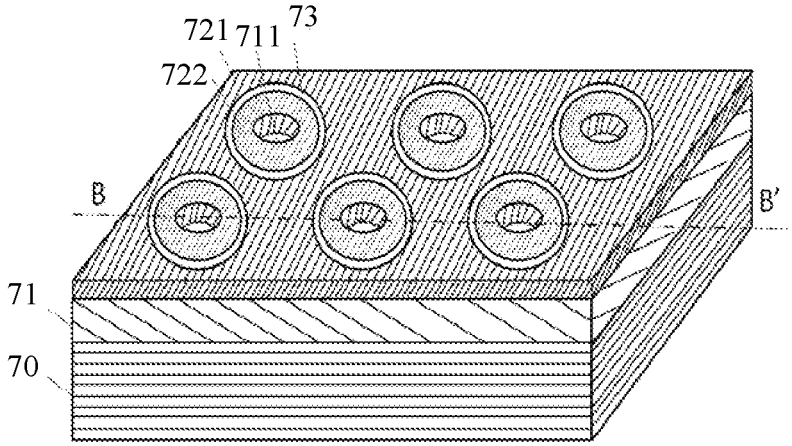
FIG. 7 is a schematic three-dimensional view of a structure of an on-chip miniature electron source according to a second embodiment of the present disclosure.
Figure 8:
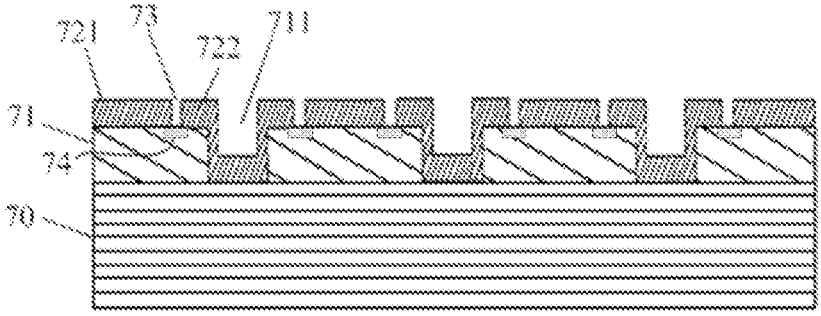
FIG. 8 is a schematic sectional view of a structure of the on-chip miniature electron source according to the second embodiment of the present disclosure, which is taken along the dashed line B-B' in FIG. 7.

Referring to FIG. 7 and FIG. 8, FIG. 7 is a schematic three-dimensional view of a structure of an on-chip miniature electron source according to a second embodiment of the present disclosure, and FIG. 8 is a schematic sectional view of a structure of the on-chip miniature electron source taken along the dashed line B-B' in FIG. 7.

The on-chip miniature electron source includes: a thermal conductive layer 70; an insulating layer 71 provided on the thermal conductive layer 70, where the insulating layer 71 is made of a resistive-switching material, and multiple through holes 711 are provided in the insulating layer 71; and multiple electrode pairs provided on the insulating layer 71, where each of the electrode pairs includes a first electrode 721 and a second electrode 722, each second electrode 722 corresponds to one of the through holes 711 and is in contact with and connected to the thermal conductive layer 70 via the through hole, and multiple second electrodes 722 are isolated from each other, for each of the electrode pairs, there is a gap 73 between the first electrode 721 and the second electrode 722, and a tunnel junction 74 is formed within the insulating layer under each gap 73.

It should be noted that, in the embodiment of the present disclosure, the tunnel junction 74 formed within the insulating layer under each gap 73 has the same structure as the tunnel junction 14 in the first embodiment, which is not repeated hereinafter for the sake of brevity.

It should be noted that the materials of the thermal conductive layer 70 and the insulating layer 71 are the same as the materials of the thermal conductive layer 10 and the insulating layer 11 provided in the first embodiment respectively, which are not repeated hereinafter for the sake of brevity.

In the on-chip miniature electron source according to the embodiment of the present disclosure, the through hole 711 provided in the insulating layer 71 may be set with different shapes, such as rectangular or circular, based on process conditions or actual requirements. In this embodiment, description is made using an example in which the on-chip miniature electron source is provided with a circular through hole 711 in the insulating layer 71.

As an example, multiple circular through holes 711 isolated from each other are provided in the insulating layer 71.

It should be noted that the first electrode 721 may be a continuous electrode layer covering on the insulating layer 71, each second electrode 722 may be an electrode island covering an inner wall of the circular through hole 711, and the electrode island is electrically isolated from the first electrode 721.

As an example, the second electrode 722 covers the insulating layer around the through hole 711.

Since the through hole 711 has a circular shape, correspondingly, the gap between the first electrode 721 and each second electrode 722 may be a circular gap. Since there are multiple second electrodes 722, an electrode pair array including multiple electrode pairs may be formed among the first electrode 721 and the second electrodes 722, and accordingly, multiple gaps 73 form a gap array.

It should be noted that, in the embodiment of the present disclosure, each gap 73 may have a width less than or equal to 10 μm.

In addition, each second electrode among the multiple second electrodes 722 is connected to the thermal conductive layer 70 via the circular through hole 711 in the insulating layer 71. In this way, heat generated during operation of the on-chip miniature electron source may be dissipated through the second electrodes 722 and thermal conductive layer 70, thereby significantly improving the heat dissipation capability of the on-chip miniature electron source, and facilitating an integration of multiple on-chip miniature electron sources on a same thermal conductive layer 70.

It should be noted that, during operation of the on-chip miniature electron source provided in the embodiment of the present disclosure, a voltage may be applied across the first electrode 721 and each of the second electrodes 722, so that electrons can be emitted from each tunnel junction, thereby forming a larger emission current.

In addition, since each of the second electrodes 722 is in contact with and connected to the thermal conductive layer 70, when the thermal conductive layer 70 is made of a material layer having a good electrical conductivity, as another example of the present disclosure, a voltage may be applied across the first electrode 721 and the thermal conductive layer 70, so as to simplify the voltage applying process. Since each of the second electrodes 722 is in contact with and connected to the thermal conductive layer 70, an electrical signal applied on the thermal conductive layer 70 will be transmitted to each of the second electrodes 722, thereby avoiding the process of applying a voltage over each of the second electrodes 722.

It should be noted that, in the foregoing embodiment, the first electrode 721 of each electrode pair serves as a common electrode. In other words, the first electrode 721 may serve as a first electrode of all the electrode pairs. In fact, as another embodiment of the present disclosure, the first electrodes of all the electrode pairs may be independent from each other.

The above illustrates an implementation of the on-chip miniature electron source provided in the second embodiment of the present disclosure. In this implementation, multiple tunnel junctions are formed inside the on-chip miniature electron source. In this way, electrons can be emitted from the multiple tunnel junctions, thereby forming a larger overall emission current.

Moreover, each of the second electrodes 722 is in contact with and connected to the thermal conductive layer 70. Therefore, heat generated during operation of the on-chip miniature electron source may be dissipated in time through the second electrodes 722 and thermal conductive layer 70, thereby significantly improving the heat dissipation capability of the on-chip miniature electron source.

The above illustrates an implementation of the on-chip miniature electron source according to the second embodiment of the present disclosure. Based on the implementation of the on-chip miniature electron source provided in the second embodiment, an implementation of a method for manufacturing the on-chip miniature electron source is further provided in the present disclosure.

Reference is made to FIG. 9 to FIG. 10(4), in which FIG. 9 is a schematic flowchart of a method for manufacturing the on-chip miniature electron source according to the second embodiment of the present disclosure; and FIG. 10(1) to FIG. 10(4) are schematic sectional views of structures corresponding to a series of processes in the method for manufacturing the on-chip miniature electron source according to the second embodiment of the present disclosure.

The method for manufacturing the on-chip miniature electron source provided in the second embodiment includes steps S901 to S905.

In step S901, a thermal conductive layer 70 is provided.

A schematic sectional view of a structure obtained by step S901 is shown in FIG. 10(1).

In step S902, an insulating layer 71 made of a resistive-switching material is formed on the thermal conductive layer 70.

A specific implementation of step S902 is described using an example in which the thermal conductive layer 70 is a silicon substrate.

When the thermal conductive layer 70 is a silicon substrate, step S902 may specifically include: placing the silicon substrate into a reaction tube and heating the reaction tube to be within a temperature range from 800° C. to 1000° C., so that a silicon oxide layer is generated on a surface of the silicon substrate, and the silicon oxide layer serves as the insulating layer 71.

A schematic sectional view of a structure obtained by step S902 is shown in FIG. 10(2).

In step S903, multiple through holes 711 are formed in the insulating layer 71.

An implementation of forming through holes 711 in step S903 may be the same as an implementation of forming the through hole 111 in the first embodiment, and will not be described in detail hereinafter for the sake of brevity.

A schematic sectional view of a structure obtained by step S903 is shown in FIG. 10(3).

In step S904, a first electrode 721 and multiple second electrodes 722 are formed on the insulating layer 71. There is a gap 73 between the first electrode 721 and each of the second electrodes 722, and each of the second electrodes 722 is connected to the thermal conductive layer 70 via the through hole 711.

Specifically, step S904 may include: depositing an electrode material layer on the insulating layer 71 and an inner wall of the through holes 711 by using an electrode deposition process which is commonly used in the art, including processes of spin coating of electron beam photoresist, electron beam exposure, developing and fixing, metal thin film deposition and lift-off process, to form the first electrode 721 and the second electrodes 722. The first electrode 721 may be an electrode layer covering on the insulating layer 71, and each of the second electrodes 722 may be an electrode layer covering the through hole 711 and the insulating layer 71 around the through hole 711.

In addition, each second electrode among the multiple second electrodes 722 formed on the insulating layer 71 is connected to the thermal conductive layer 70 via a circular through hole 711 in the insulating layer 71, thereby greatly improving the heat dissipation capability of the on-chip miniature electron source, and facilitating an integration of multiple on-chip miniature electron sources on a same thermal conductive layer 70.

A schematic sectional view of a structure obtained by step S904 is shown in FIG. 10(4).

In step S905, the insulating layer under the array of gaps 73 is controlled to be softly broken down and present a resistive-switching characteristic, to form tunnel junctions 74 within the insulating layer under the gaps 73.

An implementation of step S905 may be the same as that of step S505 in the first embodiment, and will not be described in detail hereinafter for the sake of brevity.

A schematic sectional view of a structure obtained by step S905 is shown in FIG. 8.

The above illustrates an implementation of the method for manufacturing the on-chip miniature electron source according to the second embodiment.

As another embodiment of the present disclosure, an extraction electrode may be provided on the on-chip miniature electron source, in order to accelerate the emission of electrons in the on-chip miniature electron source. Based on this, another implementation of the on-chip miniature electron source is further provided in the present disclosure, and reference may be made to a third embodiment.

Third Embodiment

It should be noted that the on-chip miniature electron source provided in the third embodiment may be obtained by making improvements on above-mentioned first or second embodiment. As an example, the third embodiment is obtained by making improvements on the second embodiment.

Figure 11:
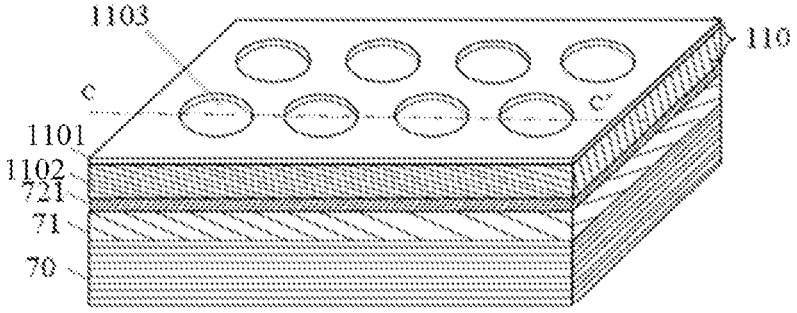
FIG. 11 is a schematic three-dimensional view of a structure of an on-chip miniature electron source according to a third embodiment of the present disclosure.
Figure 12:
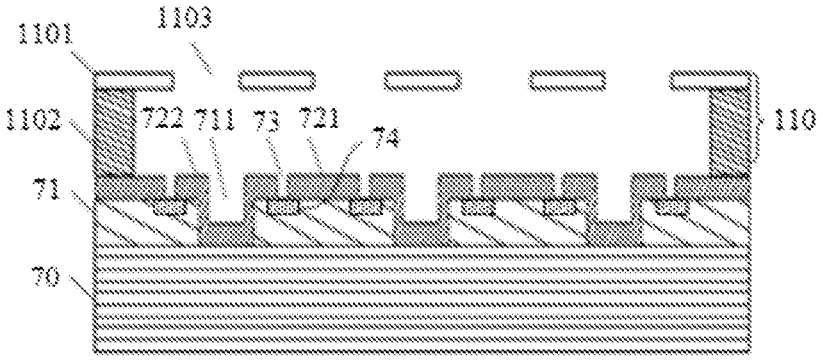
FIG. 12 is a schematic sectional view of a structure of the on-chip miniature electron source according to the third embodiment of the present disclosure, which is taken along the dashed line C-C' in FIG. 11.

Reference is made to FIG. 11 and FIG. 12, in which FIG. 11 is a schematic three-dimensional view of a structure of an on-chip miniature electron source according to the third embodiment of the present disclosure, and FIG. 12 is a schematic sectional view of a structure of the on-chip miniature electron source taken along the dashed line C-C' in FIG. 11.

In addition to all the components in the second embodiment, the on-chip miniature electron source in the present embodiment may further include an extraction electrode 110.

The extraction electrode 110 includes an extraction electrode layer 1101 and an insulating support structure 1102 provided on a side of the extraction electrode layer 1101. Multiple holes 1103 are provided on the extraction electrode layer 1101.

The insulating support structure 1102 is located between the electrode pair and the extraction electrode layer 1101, so that the extraction electrode 110 is suspended over the electrode pair.

The above illustrates a specific structure of the on-chip miniature electron source according to the third embodiment of the present disclosure. In the specific structure, when the miniature electron source is working, a positive voltage is applied across the extraction electrode 110, so that electrons emitted from the tunneling junctions 74 are accelerated by the extraction electrode 110, and are extracted to the outside of the on-chip miniature electron source through the holes 1103.

It should be noted that the holes 1103 provided on the extraction electrode layer 1101 serve as emission channels of electrons, and thus the multiple holes provided on the extraction electrode layer 1101 are more conductive to the extraction of electrons from the on-chip miniature electron source to the outside space. In fact, a solution in which the extraction electrode layer 1101 is provided with one hole 1103 also falls within the protection scope of the present disclosure.

Based on the implementation of the on-chip miniature electron source provided in the third embodiment, an implementation of a method for manufacturing the on-chip miniature electron source is further provided in the present disclosure.

Figure 13:
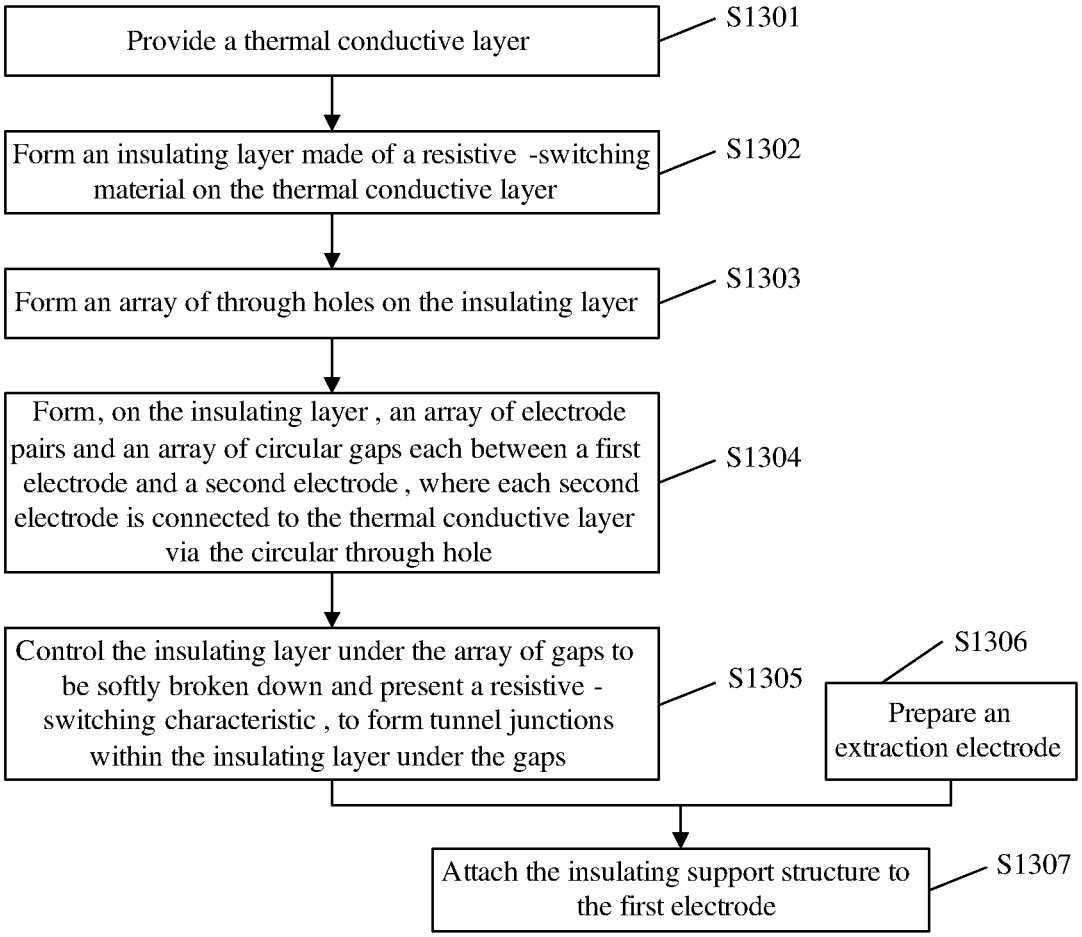
FIG. 13 is a schematic flowchart of a method for manufacturing the on-chip miniature electron source according to the third embodiment of the present disclosure.
Figure 14:
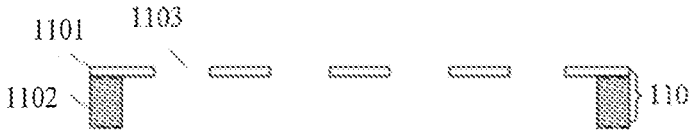
FIG. 14 is a schematic sectional view of a structure corresponding to an extraction electrode provided in the third embodiment of the present disclosure.

Reference is made to FIG. 13 to FIG. 14, in which FIG. 13 is a schematic flowchart of a method for manufacturing the on-chip miniature electron source according to the third embodiment of the present disclosure; and FIG. 14 is a schematic sectional view of a structure corresponding to an extraction electrode provided in the third embodiment of the present disclosure.

As shown in FIG. 13, the method for manufacturing the on-chip miniature electron source includes steps S1301 to S1307.

Steps S1301 to S1305 are the same as steps S901 to S905, and will not be described in detail herein for the sake of brevity. A schematic sectional view of a structure obtained by step S1305 is shown in FIG. 8.

In step S1306, an extraction electrode 110 is prepared.

The extraction electrode 110 includes an extraction electrode layer 1101 and an insulating support structure 1102 provided on a side of the extraction electrode layer 1101. At least one hole 1103 is provided on the extraction electrode layer 1101. As an example, the extraction electrode layer 1101 may be provided with multiple holes 1103.

It should be noted that the hole 1103 on the extraction electrode layer 1101 may be set with different shapes based on process conditions and requirements. As a specific example, the hole 1103 is set to have a circular shape.

As an example, in order to make electrons to be extracted to the outside space more quickly, the center of each hole 1103 is aligned with the center of a circular second electrode 722, and the radius of the circular hole 1103 is greater than the radius of the second electrode 722.

A schematic sectional view of a structure obtained by step S1306 is shown in FIG. 14.

In step S1307, the insulating support structure 1102 is attached to the first electrode 721.

Specifically, step S1307 may include: attaching the insulating support structure 1102 and the first electrode 721 together by bonding. The insulating support structure 1102 is located between the first electrode 721 and the extraction electrode layer 1101, so that the extraction electrode layer 1101 is suspended over the first electrode 721 and the second electrodes 722.

A schematic sectional view of a structure obtained by step S1307 is shown in FIG. 12.

It should be noted that, when attaching the insulating support structure 1102 and the structure formed after step S1305 to form an integral structure, it is not limited to attaching the insulating support structure 1102 and the first electrode 721 as the above example, but also includes attaching the insulating support structure 1102 and the second electrode 722, or attaching the insulating support structure 1102 and the insulating layer 71.

It should be noted that, in the present disclosure, the sequence of steps S1301 to S1305 and step S1306 is not limited. Besides, in the present disclosure, step S1305 may be performed before or after step S1307.

The above illustrates an implementation of the method for manufacturing the on-chip miniature electron source according to the third embodiment of the present disclosure.

As another embodiment of the present disclosure, a heat sink may be formed under the thermal conductive layer 70, in order to greatly improve the heat dissipation capacity of the on-chip miniature electron source. Based on this, another implementation of the on-chip miniature electron source is further provided in the present disclosure, and reference may be made to a fourth embodiment.

Fourth Embodiment

It should be noted that the on-chip miniature electron source provided in the fourth embodiment may be obtained by making improvements on the basis of the above-mentioned on-chip miniature electron source in any of the first to third embodiments. As an example, the on-chip miniature electron source in the fourth embodiment is obtained by making improvements on the basis of the third embodiment.

Figure 15:
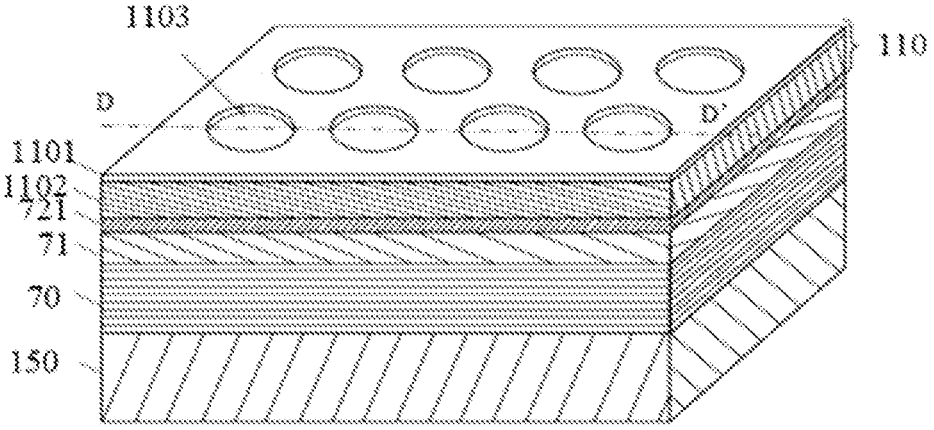
FIG. 15 is a schematic three-dimensional view of a structure of an on-chip miniature electron source according to a fourth embodiment of the present disclosure.
Figure 16:
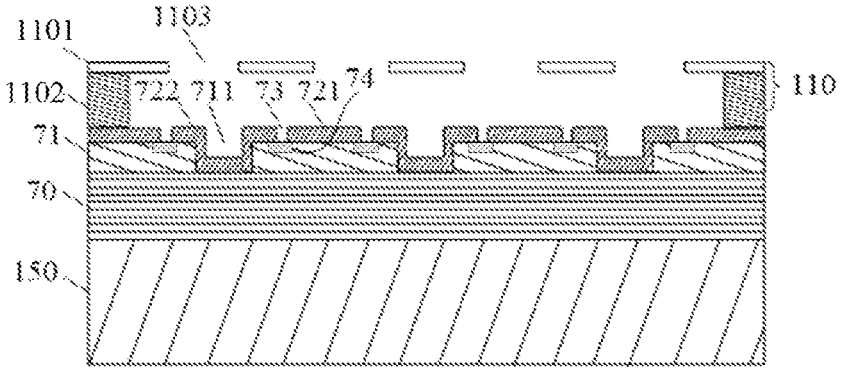
FIG. 16 is a schematic sectional view of a structure of the on-chip miniature electron source according to the fourth embodiment of the present disclosure, which is taken along the dashed line D-D' in FIG. 15.

Reference is made to FIG. 15 and FIG. 16, in which FIG. 15 is a schematic three-dimensional view of a structure of an on-chip miniature electron source according to the fourth embodiment of the present disclosure, and FIG. 16 is a schematic sectional view of a structure of the on-chip miniature electron source taken along the dashed line D-D' in FIG. 15.

In addition to all the components mentioned in the third embodiment, the on-chip miniature electron source in the present embodiment may further include a heat sink 150 provided under the thermal conductive layer 70.

The heat sink 150 and the thermal conductive layer 70 are closely attached and in good thermal contact, so that heat generated during operation of the on-chip miniature electron source may be efficiently dissipated through the second electrodes 722, the thermal conductive layer 70 and the heat sink 150 sequentially.

The above is an implementation of the on-chip miniature electron source provided in the fourth embodiment of the present disclosure. Based on the on-chip miniature electron source provided in the third embodiment, the on-chip miniature electron source in the fourth embodiment is further provided with a heat sink 150, so that the on-chip miniature electron source has a significantly improved heat dissipation capacity in addition to the same beneficial effects as the on-chip miniature electron source provided in the third embodiment.

Based on the implementation of the on-chip miniature electron source provided in the fourth embodiment, an implementation of a method for manufacturing the on-chip miniature electron source is further provided in the present disclosure.

Figure 17:
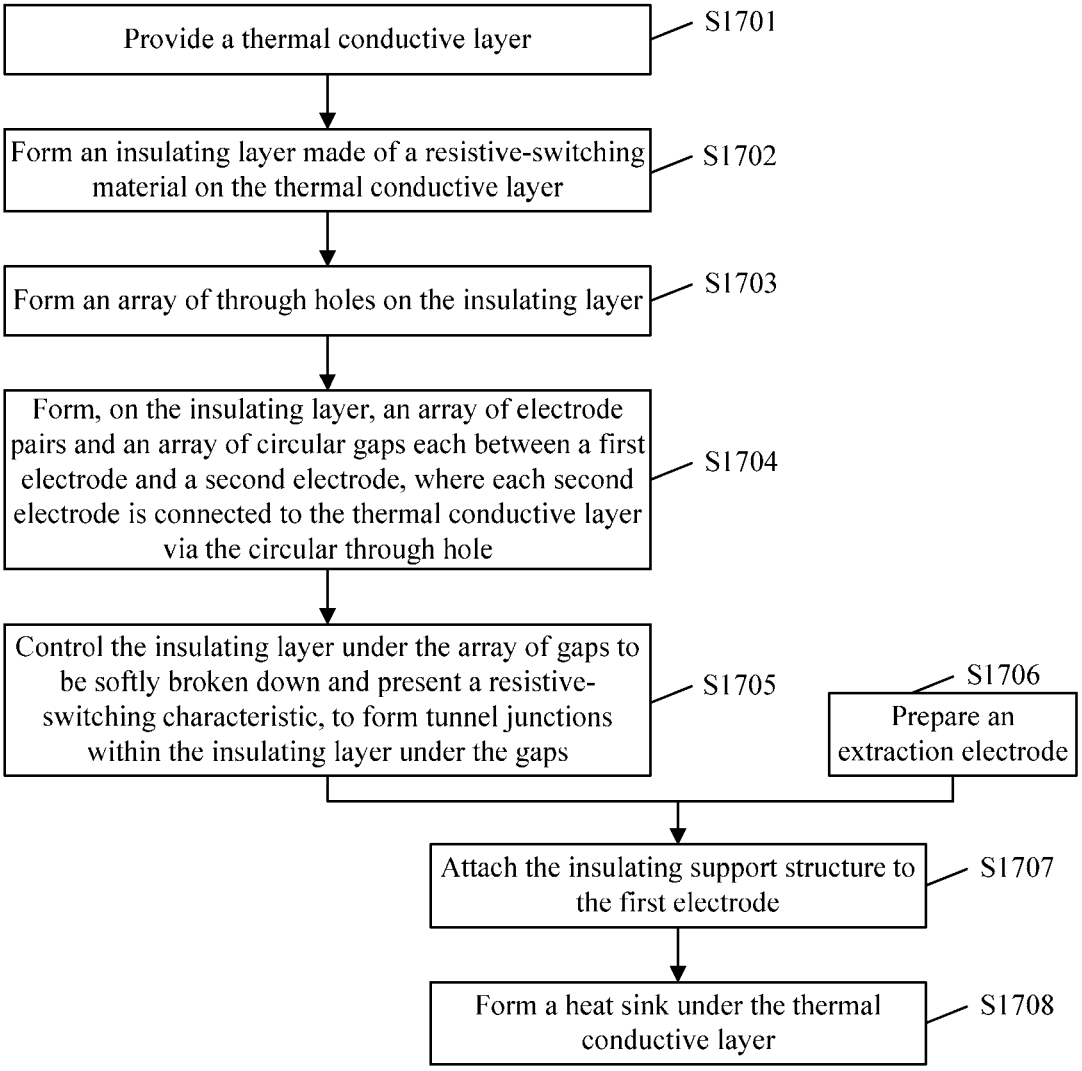
FIG. 17 is a schematic flowchart of a method for manufacturing the on-chip miniature electron source according to the fourth embodiment of the present disclosure.

Reference is made to FIG. 17, which is a schematic flowchart of a method for manufacturing the on-chip miniature electron source according to the fourth embodiment of the present disclosure.

The method for manufacturing the on-chip miniature electron source provided in the fourth embodiment includes steps S1701 to S1708.

Steps S1701 to S1707 are the same as steps S1301 to S1307, and will not be described in detail hereinafter for the sake of brevity. A schematic sectional view of a structure obtained by step S1707 is shown in FIG. 12.

In step S1708, a heat sink 150 is formed under the thermal conductive layer 70.

Specifically, step S1708 may include: attaching the thermal conductive layer 70 and the heat sink 150 through a thermal conductive adhesive layer, so that the thermal conductive layer 70 and the heat sink 150 are closely attached and in good thermal contact. Thus, heat generated during operation of the on-chip miniature electron source may be efficiently dissipated through the second electrodes 722, the thermal conductive layer 70 and the heat sink 150 sequentially.

A schematic sectional view of a structure obtained by step S1708 is shown in FIG. 16.

The above is a specific implementation of the method for manufacturing the on-chip miniature electron source provided in the fourth embodiment. The on-chip miniature electron source manufactured by this implementation has the same advantages as the on-chip miniature electron source described in the third embodiment, which is not repeated hereinafter for the sake of brevity.

The foregoing embodiments are only preferred embodiments of the present disclosure. The preferred embodiments are used to disclose the present disclosure, rather than limiting the present disclosure. With the method and technical content disclosed above, those skilled in the art may make some variations and improvements to the technical solutions of the present disclosure, or make some equivalent variations on the embodiments without departing from the scope of technical solutions of the present disclosure. All simple modifications, equivalent variations and improvements made based on the technical essence of the present disclosure without departing from the content of the technical solutions of the present disclosure fall within the protection scope of the technical solutions of the present disclosure.

The invention claimed is:

1. An on-chip miniature electron source, comprising:

a thermal conductive layer;

an insulating layer provided on the thermal conductive layer, wherein the insulating layer is made of a resistive-switching material, and at least one through hole is provided in the insulating layer; and at least one electrode pair provided on the insulating layer, wherein at least one electrode of the at least one electrode pair is in contact with and connected to the thermal conductive layer via the at least one through hole, wherein there is a gap between two electrodes of the at least one electrode pair, and a tunnel junction is formed within a region of the insulating layer under the gap.

2. The on-chip miniature electron source according to claim 1, wherein the gap has a width less than or equal to 10 microns.

3. The on-chip miniature electron source according to claim 1, wherein the on-chip miniature electron source further comprises:

an extraction electrode, wherein the extraction electrode comprises an extraction electrode layer and an insulating support structure provided on a side of the extraction electrode layer, and at least one hole is provided on the extraction electrode layer, wherein the insulating support structure is located between the at least one electrode pair and the extraction electrode layer, so that the extraction electrode layer is suspended over the at least one electrode pair.

4. The on-chip miniature electron source according to claim 1, wherein the on-chip miniature electron source further comprises:

a heat sink provided under the thermal conductive layer, wherein the thermal conductive layer is attached to the heat sink.

5. The on-chip miniature electron source according to claim 1, wherein the insulating layer is made of one or more materials selected from: silicon oxide, tantalum oxide, hafnium oxide, tungsten oxide, zinc oxide, magnesium oxide, zirconium oxide, titanium oxide, aluminum oxide, nickel oxide, germanium oxide, diamond and amorphous carbon.

6. The on-chip miniature electron source according to claim 1, wherein the two electrodes of the electrode pair are made of one or more materials selected from metal, graphene, and carbon nanotube.

7. The on-chip miniature electron source according to claim 1, wherein the thermal conductive layer is made of one or more materials selected from metal, diamond, and heavily doped semiconductor.

8. The on-chip miniature electron source according to claim 1, wherein the thermal conductive layer is a substrate or a material layer provided on the substrate.

9. A method for manufacturing an on-chip miniature electron source, comprising:

providing a thermal conductive layer;

forming, on the thermal conductive layer, an insulating layer made of a resistive-switching material, wherein at least one through hole is provided in the insulating layer;

forming at least one electrode pair covering a part of a surface of the insulating layer, wherein there is a gap between two electrodes of the at least one electrode pair, and at least one electrode of the at least one electrode pair is in contact with and connected to the thermal conductive layer via the at least one through hole; and controlling the insulating layer under the gap to be softly broken down and present a resistive-switching characteristic, to form a tunnel junction within a region of the insulating layer under the gap.

10. The method according to claim 9, wherein the method further comprises:

preparing an extraction electrode, wherein the extraction electrode comprises an extraction electrode layer and an insulating support structure provided on a side of the extraction electrode layer, and at least one hole is provided on the extraction electrode layer, and wherein before or after the controlling the insulating layer under the gap to be softly broken down and present a resistive-switching characteristic, to form a tunnel junction within a region of the insulating layer under the gap, the method further comprises:

attaching the insulating support structure and the at least one electrode pair, and/or attaching the insulating support structure and the insulating layer, so that the extraction electrode layer is suspended over the at least one electrode pair.

11. The method according to claim 9, wherein the method further comprises:

forming a heat sink under the thermal conductive layer, wherein the heat sink is in contact with the thermal conductive layer.

12. The on-chip miniature electron source according to claim 3, wherein the on-chip miniature electron source further comprises:

a heat sink provided under the thermal conductive layer, wherein the thermal conductive layer is attached to the heat sink.

13. The on-chip miniature electron source according to claim 3, wherein the insulating layer is made of one or more materials selected from: silicon oxide, tantalum oxide, hafnium oxide, tungsten oxide, zinc oxide, magnesium oxide, zirconium oxide, titanium oxide, aluminum oxide, nickel oxide, germanium oxide, diamond and amorphous carbon.

14. The on-chip miniature electron source according to claim 3, wherein the two electrodes of the at least one electrode pair are made of one or more materials selected from metal, graphene, and carbon nanotube.

15. The method according to claim 10, wherein the method further comprises:

forming a heat sink under the thermal conductive layer, wherein the heat sink is in contact with the thermal conductive layer.

* * * * *